US009873923B2

(12) United States Patent
Murao et al.

(10) Patent No.: US 9,873,923 B2
(45) Date of Patent: Jan. 23, 2018

(54) BLAST FURNACE OPERATION METHOD

(71) Applicant: JFE STEEL CORPORATION, Chiyoda-ku, Tokyo (JP)

(72) Inventors: Akinori Murao, Tokyo (JP); Daiki Fujiwara, Tokyo (JP); Shiro Watakabe, Tokyo (JP); Michitaka Sato, Tokyo (JP); Takashi Watanabe, Tokyo (JP); Akio Shimomura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 199 days.

(21) Appl. No.: 14/785,165

(22) PCT Filed: Mar. 28, 2014

(86) PCT No.: PCT/JP2014/059090
§ 371 (c)(1),
(2) Date: Oct. 16, 2015

(87) PCT Pub. No.: WO2014/171297
PCT Pub. Date: Oct. 23, 2014

(65) Prior Publication Data

US 2016/0138120 A1 May 19, 2016

(30) Foreign Application Priority Data

Apr. 19, 2013 (JP) ..... 2013-088580

(51) Int. Cl.
*C21B 7/16* (2006.01)
*C21B 5/00* (2006.01)
(Continued)

(52) U.S. Cl.
CPC ..... *C21B 5/003* (2013.01); *C21B 5/007* (2013.01); *F27D 3/16* (2013.01); *F27D 3/18* (2013.01);
(Continued)

(58) Field of Classification Search
CPC ..... C21B 5/003; C21B 5/007
See application file for complete search history.

(56) References Cited

U.S. PATENT DOCUMENTS 3,411,765 A 11/1968 Schmidt
2011/0180978 A1* 7/2011 Goedert ..... C21B 5/003 266/47
(Continued)

FOREIGN PATENT DOCUMENTS

JP S57-144443 A 9/1982
JP 10310808 11/1998
(Continued)

OTHER PUBLICATIONS

Supplementary European Search Report for Application No. EP 14 78 5099, dated Mar. 24, 2016.
(Continued)

*Primary Examiner* — Scott Kastler
(74) *Attorney, Agent, or Firm* — RatnerPrestia

(57) ABSTRACT

A method of operating a blast furnace by blowing a pulverized coal at an amount of not less than 150 kg/t–p from tuyeres through a lance into a blast furnace, wherein when the operation is performed under a condition that lump coke charged from a furnace top has a strength defined in JIS K2151 ($DI^{150}_{15}$) of not more than 87%, the pulverized coal blown through the tuyere contains not more than 60 mass % as a weight ratio of coal having a particle size of not more than 74 μm and has an average volatile matter of not more than 25 mass %, and a blast temperature blown through the
(Continued)

tuyere is not higher than 1100° C., oxygen is simultaneously blown into the furnace with the blowing of the pulverized coals through the lance and a gas having an oxygen concentration of 60 vol %-97 vol % is used as a carrier gas for the blowing of the pulverized coal.

20 Claims, 1 Drawing Sheet

(51) Int. Cl.
*F27D 3/16* (2006.01)
*F27D 3/18* (2006.01)

(52) U.S. Cl.
CPC .. *F27D 2003/168* (2013.01); *F27D 2003/185* (2013.01)

(56) References Cited

U.S. PATENT DOCUMENTS

2014/0131929 A1* 5/2014 Murao ..... C21B 5/003 266/44
2014/0159287 A1* 6/2014 Fujiwara ..... C21B 5/003 266/47
2016/0138120 A1* 5/2016 Murao ..... C21B 5/003 266/47

FOREIGN PATENT DOCUMENTS

| | | |
|---|---|---|
| JP | 2003286511 | 10/2003 |
| JP | 2006307306 | 11/2006 |
| JP | 2007100161 | 4/2007 |
| JP | 2008240044 | 10/2008 |
| JP | 2011127176 | 6/2011 |
| JP | 2012188743 | 10/2012 |

OTHER PUBLICATIONS

Korean Office Action for Application No. 2015-7028490, dated Jul. 1, 2016 with Concise Statement of Relevance of Office Action, 6 pages.
International Search Report for International Application No. PCT/JP2014/059090 dated May 27, 2014.

* cited by examiner

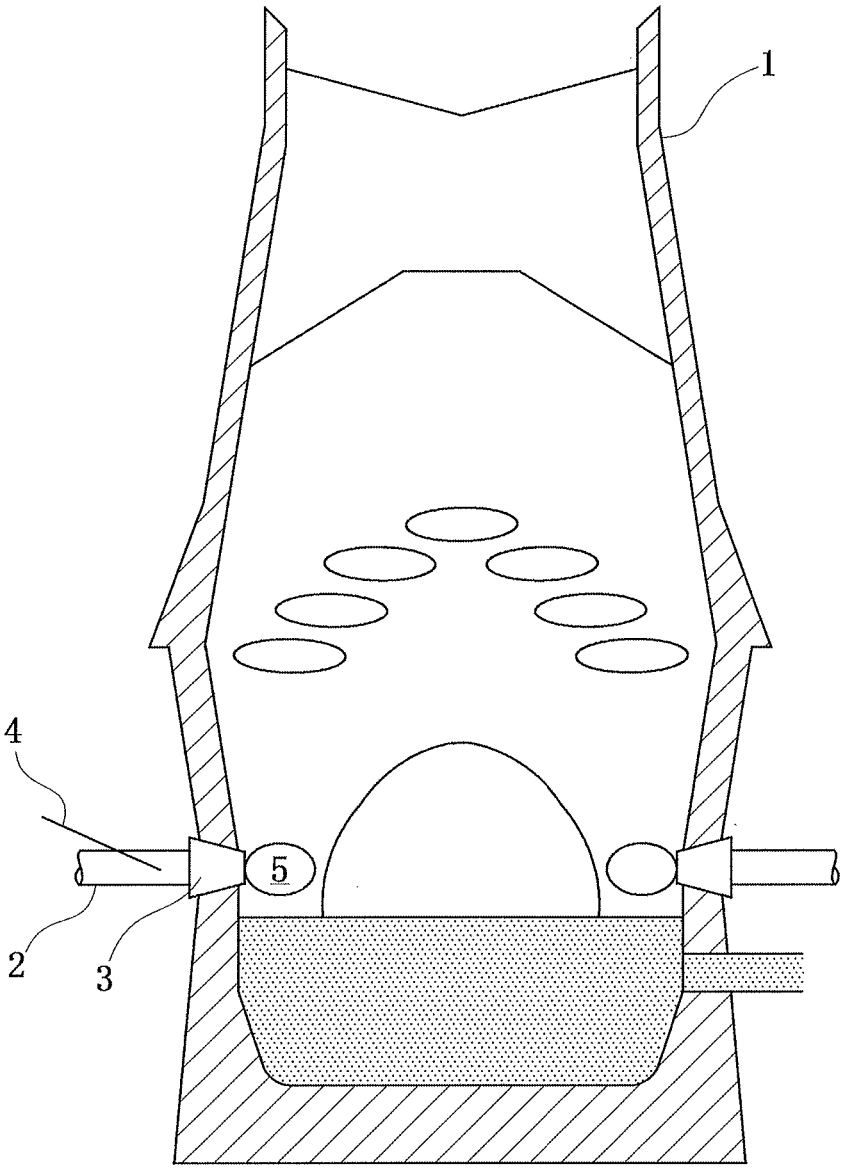
1
4
5
2
3

BLAST FURNACE OPERATION METHOD

CROSS REFERENCE TO RELATED APPLICATIONS

This is the U.S. National Phase application of PCT/JP2014/059090, filed Mar. 28, 2014, which claims priority to Japanese Patent Application No. 2013-088580, filed Apr. 19, 2013, the disclosures of each of these applications being incorporated herein by reference in their entireties for all purposes.

FIELD OF THE INVENTION

This invention relates to a method of operating a blast furnace by blowing a pulverized coal through tuyeres of a blast furnace into the inside thereof.

BACKGROUND OF THE INVENTION

Recently, global warming comes into problem with the increase of carbon dioxide emission, and the suppression of $CO_2$ emission becomes an important issue in the iron industry. In recent blast furnaces is used lump coke charged from a top portion of the furnace and pulverized coal blown through tuyeres as a reducing material. The use of pulverized coal blown through the tuyeres into the furnace is considered to easily lead to the suppression of $CO_2$ emission as compared to the use of the lump coke charged from the top of the furnace in view of the difference in the carbon dioxide emission generated by a pretreatment for suppressing $CO_2$ emission.

In general, as to the blowing of the pulverized coal through the tuyeres, Patent Document 1 discloses that pulverized coal containing a volatile matter of not more than 25 mass % is blown at a rate of not less than 150 kg/t per 1 ton of pig iron as a pulverized coal ratio. In this case, it is attempted to improve combustion efficiency by feeding oxygen of not less than 70 vol % through a lance together with the pulverized coal for preventing the decrease in the combustion efficiency of the pulverized coal. Further, Patent Document 1 proposes a method wherein when the lance is a single tube, a mixture of oxygen and pulverized coal is blown from the lance, while when the lance is a double tube, the pulverized coal is blown from an inner tube and oxygen is blown from between an inner tube and an outer tube.

Patent Document 2 proposes a method wherein when the combustion efficiency is decreased at the pulverized coal ratio of not less than 150 kg/t−p during the production cutback (tapping ratio of not more than 1.8), a high-volatile pulverized coal containing a volatile matter of not less than 28 mass % is used and a heat flow ratio represented by a ratio of solid heat volume to gas heat volume is controlled to not more than 0.8.

PATENT DOCUMENTS

Patent Document 1: JP-A-2003-286511
Patent Document 2: JP-A-2011-127176

SUMMARY OF THE INVENTION

The pulverized coal blown through the tuyeres into the furnace has a role of providing a heat source or a reducing material source. The combustibility of the pulverized coal is known to be affected by unburned powder (unburned char). That is, in the blast furnace is caused a solution loss reaction represented by $C+CO_2=2CO$, in which the reaction quantity is varied by operation condition but is said to be about 80-100 kg-C/t−p. As C source consumed by this reaction is considered lump coke charged from the top of the furnace, coke breeze included in sintered ores and unburned powder of pulverized coal. In these C sources, it is considered that the unburned powder of the pulverized coal is preferentially consumed in response to the difference of specific surface area (particle size).

When the combustibility of the pulverized coal blown through the tuyeres is decreased, therefore, the amount of the unburned powder blown into the furnace is increased and preferentially consumed by the solution loss reaction, and hence coke breeze to be consumed retains in the furnace without being consumed. As the amount of the coke breeze retained in the furnace is increased, it leads to the decrease of porosity or average particle size in the blast furnace and hence to bring about the deterioration of air permeability in the furnace. The amount of coke breeze generated in the furnace is known to be largely affected by cold strength of coke (JIS K2151: drum strength). Therefore, the evaluation of air permeability in the furnace is important to be simultaneously considered by not only the combustibility of the pulverized coal blown through the tuyeres but also the characteristics of the lump coke charged from the furnace top.

In the technique disclosed in Patent Document 1, when ones containing a volatile matter of not more than 25 mass % are used as the pulverized coal blown through the tuyeres and the operation is performed under a condition of pulverized coal ratio of not less than 150 kg/t−p or a condition of decreasing the combustion efficiency of the pulverized coal, oxygen is simultaneously fed with the blowing of the pulverized coal through the lance and particularly oxygen concentration in a carrier gas for blowing the pulverized coal is made to not less than 70 vol %, whereby the combustion efficiency is increased to improve the air permeability in the furnace. Even in the pulverized coals having the same volatile matter (not more than 25 mass %), however, it has been confirmed that the combustion efficiency may not be increased in accordance with the particle size or the blast temperature even if the oxygen concentration in the carrier gas is made to not less than 70 vol %, or the combustion efficiency can be maintained at a high level if the oxygen concentration in the carrier gas is not made to not less than 70 vol %.

As to the air permeability in the blast furnace, it has been found that even when the combustion efficiency of the pulverized coal is somewhat decreased, if the strength of the lump coke charged from the furnace top is large, the bad influence on the air permeability is small. In Patent Document 1, therefore, there is a problem that the effect may not be developed in accordance with the characteristics of the pulverized coal to be blown or the lump coke charged from the furnace top and the blast conditions or inversely the effect becomes excessive to increase the cost.

Since further reduction of $CO_2$ emission is demanded in recent years, it is desired, for example, to make the pulverized coal ratio not less than 170 kg/t−p. In the operation at a high pulverized coal ratio of not less than 170 kg/t−p, however, even if the pulverized coal is blown through an inner tube of the double tube lance and oxygen is blown from between an inner tube and an outer tube as described in Patent Document 1, the combustion temperature is saturated and the combustion efficiency may not be increased. Also, the blowing lance inserted into the blowpipe is exposed to hot air of 1000-1200° C., so that the feeding of the mixture of high-concentration oxygen and pulverized coal through the single tube lance as described in Patent Document 1 is not realistic from the viewpoint of the safety.

In Patent Document 2, if the combustion efficiency is decreased by making the pulverized coal ratio not less than 150 kg/t–p during the production cutback, the high-volatile pulverized coal containing a volatile matter of not less than 28 mass % is used and the hot flow ratio represented by a ratio of solid heat volume to gas heat volume is controlled to not more than 0.8, whereby the combustion of the pulverized coal is intended to be made efficient. In this case, however, oxygen enrichment ratio is decreased to not more than 2.0 vol %, preferably not more than 1.5 vol % for decreasing the hot flow ratio, which means the decrease in the combustion efficiency of the pulverized coal. This may not lead to the improvement of the combustion efficiency in accordance with the blast condition (blast temperature) and the characteristics of the pulverized coal (granularity) even if the volatile matter is set to not less than 28 mass %.

The invention is made for solving the above problems inherent to the conventional techniques. That is, it is an object of the invention to propose a blast furnace operation method capable of increasing the productivity and decreasing $CO_2$ emission, e.g., by raising the combustion temperature of the pulverized coal even in the operation at a pulverized coal ratio of not less than 150 kg/t–p.

The invention developed for solving the above task includes, according to one aspect, a method of operating a blast furnace by blowing a pulverized coal at an amount of not less than 150 kg/t–p from tuyeres through a lance into a blast furnace, wherein when the operation is performed under two or more of the following three conditions a, b and c:

a. lump coke charged from a furnace top has a strength defined in JIS K2151 ($DI^{150}_{15}$) of not more than 87%;

b. the pulverized coal blown through the tuyere contains not more than 60 mass % as a weight ratio of coal having a particle size of not more than 74 μm and has an average volatile matter of not more than 25 mass %; and c. a blast temperature blown through the tuyere is not higher than 1100° C.;

oxygen is simultaneously blown into the furnace with the blowing of the pulverized coals through the lance and a gas having an oxygen concentration of 60 vol %-97 vol % is used as a carrier gas for the blowing of the pulverized coal.

In embodiments of the invention are provided the following features as a preferable means:

(1) when the strength ($DI^{150}_{15}$) of the lump coke is not more than 85%, a gas having an oxygen concentration of 70 vol %-97 vol % is used as a carrier gas;

(2) when the strength ($DI^{150}_{15}$) of the lump coke is not more than 83%, a gas having an oxygen concentration of 80 vol %-97 vol % is used as a carrier gas;

(3) the strength ($DI^{150}_{15}$) of the lump coke is not less than 78%;

(4) a weight ratio of a pulverized coal having a particle size of not more than 74 μm is not less than 30 mass %;

(5) the blast temperature is made to not less than 900° C.; and (6) the amount of the pulverized coal blown is not more than 300 kg/t–p.

According to the blast furnace operation method of embodiments of the invention, it is attempted to improve the combustion efficiency of the pulverized coal blown from the tuyere by totally judging the air permeability in the furnace while considering the strength of the lump coke charged from the furnace top under a condition of lowering the combustion efficiency of the pulverized coal, so that the increase of the productivity and the decrease of $CO_2$ emission can be attained efficiently. That is, according to embodiments of the invention, the combustion efficiency of the pulverized coal is judged from the amount, characteristics (granularity, volatile matter) and blast temperature of the pulverized coal blown through the tuyere and so on, while the air permeability is totally judged from the combustion efficiency of the pulverized coal and the strength of the lump coke used, whereby it is made possible to set the combustion efficiency of the pulverized coal to an optimum range. Consequently, it is possible to always maintain the combustion efficiency of the pulverized coal efficiently, and hence the air permeability in the furnace can be stabilized to attain the increase of the productivity and the decrease of $CO_2$ emission.

BRIEF DESCRIPTION OF THE DRAWING

FIG. 1 is a schematic view of a blast furnace adapted to an example of the invention method.

DETAILED DESCRIPTION OF EMBODIMENTS OF THE INVENTION

FIG. 1 is a view illustrating an outline of a blast furnace applied to the blast furnace operation method according to an example of the invention. As shown in this FIGURE, a blowpipe (blast pipe) 2 for blowing hot air is connected to a tuyere 3 at the rear part thereof in a blast furnace 1, and a lance 4 is inserted into the blowpipe 2 in a direction of directing toward the inside of the furnace. A combustion space being a coke deposited layer and called as a raceway 5 is considered to be existent ahead the tuyere 3 in a direction of blowing hot air. The reduction of iron ore is mainly performed in this combustion space. Although only one lance 4 is inserted into the blowpipe 2 in this FIGURE, it is common that the lance 4 is inserted into each of the plural blowpipes 2 arranged along the periphery of the furnace. Also, the number of lances per one blowpipe is not limited to one, and hence two or more lances may be arranged. As a structure of the lance may be used a single tube lance, a multiple-tube type lance and a tube bundling type lance prepared by bundling plural blowing tubes.

In general, a pulverized coal blown through the lance 4 inserted into the blowpipe 2 arrives at the raceway 5 through the tuyere 3 in the blast furnace, where volatile matter and fixed carbon included in the pulverized coal and lump coke charged from a furnace top are combusted to raise the temperature. An aggregate of unburned carbon and ash called as a char is discharged out of the raceway 5 as an unburned char. This char is composed mainly of the fixed carbon and generates a reaction called as a carbon dissolution reaction in addition to the combustion reaction.

When the pulverized coal blown through the lance 4 into the blowpipe 2 and tuyere 3 contains a greater amount of volatile matter, ignition combustion is promoted to increase combustion volume, whereby a heating rate and a maximum temperature of the pulverized coal are raised and a reaction rate of the char is increased associated with the increase of dispersibility and temperature of the pulverized coal. That is, the pulverized coal is widely dispersed associated with the vaporization expansion of the volatile matter to promote the combustion of the volatile matter, and further the pulverized coal is rapidly heated by combustion heat to raise the temperature. Thus, for example, the pulverized coal is combusted at a place near to the furnace wall efficiently. As to the lump coke strength defined in JIS K2151 ($DI^{150}_{15}$) [%], it is considered that as the lump coke strength ($DI^{150}_{15}$) [%] becomes larger, the rate of coke breeze in the furnace becomes less and the amount of coke breeze deposited into a central portion of the furnace becomes small.

An operation test evaluating air permeability is performed in a blast furnace of 5000 $m^3$ in volume by changing a strength of lump coke charged from a furnace top ($DI^{150}_{15}$) [%], an amount of pulverized coal, characteristics of the pulverized coal (granularity, volatile matter) and a blast temperature to examine blast furnace operation conditions adapted to aspects of the invention. The results are explained below.

In this operation test, a blast volume is controlled so as to make a tapping amount of 10000 t/d constant, and the air permeability is compared every each condition. Moreover, the value of the air permeability is obtained from a pressure difference between pressure at a furnace top portion and blast pressure and the blast volume.

Also, the operation test is performed so that the temperature at the tip of the tuyere is controlled to a certain range by adjusting a humidity content in the blast, whereby a temperature of pig iron is set to a range of 1500° C.±10° C. in each level. As shown in Table 1, the operation is performed under a condition as a test condition 1 that a coke ratio is 340 kg/t−p, a pulverized coal ratio is 150 kg/t−p, a blast temperature is 1100° C., a coke strength ($DI^{150}_{15}$) is 87%, a volatile matter of the pulverized coal is 25 mass % and a granularity of pulverized coal having a particle size of not more than 74 μm is 60 mass %. The air permeability in this operation is 1.0, to which an air permeability obtained by changing the each operation condition is relatively compared. As the numerical value of the air permeability becomes larger, the air permeability is deteriorated, but an index of air permeability up to 1.05 is an acceptable range in the stable operation. Moreover, the one single tube lance per tuyere is used in all of the operation tests.

In these operation tests, the blast temperature, volatile matter in the pulverized coal and granularity of the pulverized coal are relatively compared based on the test condition 1. In case of a test condition 2, both the coke ratio and air permeability are improved by changing all items (the blast temperature and the like) in a direction of increasing combustion efficiency as compared to the test condition 1. Moreover, the direction of increasing the combustion efficiency means that the blast temperature is made high and the volatile matter in the pulverized coal is made large and the granularity of the pulverized coal is made large. In case of a test condition 3, only the pulverized coal ratio is set to +10 kg/t−p as compared to the test condition 1, so that the air permeability is somewhat deteriorated but is within the acceptable range of the stable operation. In case of test conditions 4-6, only one of the volatile matter in the pulverized coal, the granularity of the pulverized coal and the blast temperature is operated in a direction of decreasing the combustion efficiency as compared to the test condition 3, that is, the blast temperature is decreased or the volatile matter in the pulverized coal is made low or the granularity of the pulverized coal is made small. In the test conditions 4-6, the air permeability is somewhat deteriorated but is within the acceptable range of the stable operation.

In case of test conditions 7-9, two items of the volatile matter in the pulverized coal, the granularity of the pulverized coal and the blast temperature are adjusted in a direction of decreasing the combustion efficiency as compared to the test condition 3 under a condition that the lump coke strength ($DI^{150}_{15}$) is 88%. In the test conditions 7-9, the air permeability is somewhat deteriorated but is within the acceptable range of the stable operation. This is considered due considered that the lump coke strength ($DI^{150}_{15}$) is increased to suppress deposition of coke breeze in the furnace and hence the air permeability is not so damaged. In case of test conditions 10-12, the coke strength ($DI^{150}_{15}$) is decreased to 85.5% and further two items of the volatile matter in the pulverized coal, the granularity of the pulverized coal and the blast temperature are adjusted in a direction of decreasing the combustion efficiency as compared to the test condition 3. As a result, the air permeability is significantly deteriorated and the stable operation is difficult regardless of increasing the coke ratio. This is considered due to the fact that the deposition of coke breeze in the furnace is deteriorated due to the lowering of the coke strength ($DI^{150}_{15}$).

TABLE 1

| | | Test conditions | | | | | | |
|---|---|---|---|---|---|---|---|---|
| | | 1 | 2 | 3 | 4 | 5 | 6 | 7 |
| Tapping amount | T/d/$m^3$ | 10000 | 10000 | 10000 | 10000 | 10000 | 10000 | 10000 |
| Coke ratio | Kg/t | 340 | 333 | 334 | 335 | 335 | 337 | 343 |
| Pulverized coal ratio | Kg/t | 150 | 150 | 160 | 160 | 160 | 160 | 160 |
| Reducing material ratio | Kg/t | 490 | 483 | 494 | 495 | 495 | 497 | 503 |
| Blast temperature | ° C. | 1100 | 1200 | 1100 | 1100 | 1100 | 1050 | 1100 |
| Coke strength | % | 87 | 87 | 87 | 87 | 87 | 87 | 88 |
| Volatile matter in pulverized coal | % | 25 | 30 | 25 | 15 | 25 | 25 | 15 |
| Granularity of pulverized coal** | % | 60 | 70 | 60 | 60 | 50 | 60 | 50 |
| Oxygen concentration* | % | — | — | — | — | — | — | — |
| Index of air permeability | — | 1.00 | 0.98 | 1.03 | 1.04 | 1.02 | 1.01 | 1.03 |

| | | Test conditions | | | | |
|---|---|---|---|---|---|---|
| | | 8 | 9 | 10 | 11 | 12 |
| Tapping amount | T/d/$m^3$ | 10000 | 10000 | 10000 | 10000 | 10000 |
| Coke ratio | Kg/t | 345 | 345 | 350 | 348 | 351 |

TABLE 1-continued

| | | | | | | |
|---|---|---|---|---|---|---|
| Pulverized coal ratio | Kg/t | 160 | 160 | 160 | 160 | 160 |
| Reducing material ratio | Kg/t | 505 | 505 | 510 | 508 | 511 |
| Blast temperature | ° C. | 1050 | 1050 | 1050 | 1100 | 1050 |
| Coke strength | % | 88 | 88 | 85.5 | 85.5 | 85.5 |
| Volatile matter in pulverized coal | % | 15 | 25 | 15 | 15 | 25 |
| Granularity of pulverized coal** | % | 60 | 50 | 60 | 50 | 50 |
| Oxygen concentration* | % | — | — | — | — | — |
| Index of air permeability | — | 1.04 | 1.05 | 1.12 | 1.11 | 1.14 |

**74 mass %

*Oxygen concentration of carrier gas

A double-tube type lance is used in each operation test shown in the following Tables 2 and 3, in which pulverized coal is blown through an inner tube of the double-tube type lance and oxygen is blown from between an inner tube and an outer tube. In this case, the pulverized coal is blown through the inner tube of the double-tube type lance together with a carrier gas such as nitrogen or the like. Moreover, the blowing pattern in the double-tube type lance may be opposite to the said blowing pattern. Also, a tube bundling type lance prepared by bundling single tubes can be used instead of the double-tube type lance, in which the pulverized coal is blown through either one of the two single tubes and oxygen is blown through the other tube. In any cases, it is preferable to blow oxygen close to the pulverized coal blown. When the single tube lance is used instead of the double-tube type lance, the pulverized coal and oxygen (and carrier gas) may be transferred in admixture.

As shown in Tables 2 and 3, the test 13 is a blast furnace operation method of simultaneously blowing pulverized coal and oxygen (carrier gas) through the lance based on the test condition 10 of Table 1. That is, the pulverized coal is blown through the inner tube of the double-tube type lance together with the carrier gas, and an oxygen-containing carrier gas ($N_2$+$O_2$) is blown from between the inner tube and the outer tube of the double-tube type lance. As a result, when the oxygen concentration of the carrier gas for blowing oxygen and pulverized coal through the double-tube type lance is merely set to 50 vol %, the effect of improving the air permeability is insufficient. In the test conditions 14-16, the oxygen concentration in the carrier gas through the double-tube type lance is set to 60 vol % as compared to the test conditions 10-12 of Table 1, so that the effect of improving the air permeability is confirmed and it is possible to perform the stable operation. In the test conditions 17-19, the oxygen concentration in the carrier gas for carrying the pulverized coal through the double-tube type lance is set to 70 vol % as compared to the test conditions 10-12, so that the effect of further improving the air permeability is confirmed as compared to the test conditions 14-16 and the improvement of the air permeability is confirmed as compared to the test condition 1. In the test 20, the blast furnace operation of blowing the pulverized coal and oxygen through the lance is applied to the test condition 1, in which the pulverized coal is blown through the inner tube of the double-tube type lance together with the carrier gas and oxygen (carrier gas) is blown from between the inner tube and the outer tube. As seen from the results of Table 2, the pulverized coal ratio can be improved by increasing the combustion efficiency of the pulverized coal and it is possible to largely decrease the coke ratio under good air permeating condition. In the test conditions 21-23, the coke strength ($DI^{150}{}_{15}$) is decreased from 85.5% to 84.5% as compared to the test conditions 14-16. As a result, the air permeability is deteriorated because the oxygen concentration in the carrier gas is set to 60 vol % like the test conditions 14-16.

As shown in Table 3, the air permeability is improved in the test conditions 24-26, because the oxygen concentration in the carrier gas is set to 70 vol % as compared to the test conditions 21-23. That is, the combustibility of the pulverized coal can be improved by increasing the oxygen concentration in the carrier gas even under the condition that the coke strength ($DI^{150}{}_{15}$) is decreased to 84.5%, which means that the stable operation is made possible.

In the test conditions 27-29, the coke strength ($DI^{150}{}_{15}$) is decreased from 84.5% to 82.5% as compared to the test conditions 24-26. In this case (test conditions 27-29), the oxygen concentration in the carrier gas for carrying the pulverized coal through the double-tube type lance is set to 70 vol % like the test conditions 24-26, so that the air permeability is significantly deteriorated. In the test conditions 30-32, the oxygen concentration in the carrier gas is increased to 80 vol % as compared to the test conditions 27-29, whereby the air permeability is improved. Thus, even when the coke strength ($DI^{150}{}_{15}$) is decreased to 82.5%, the combustibility of the pulverized coal is improved by increasing the oxygen concentration in the carried gas for the pulverized coal in the lance, whereby it is made possible to perform the stable operation.

TABLE 2

| | | Test conditions | | | | | |
|---|---|---|---|---|---|---|---|
| | | 13 | 14 | 15 | 16 | 17 | 18 |
| Tapping amount | T/d/m³ | 10000 | 10000 | 10000 | 10000 | 10000 | 10000 |
| Coke ratio | Kg/t | 339 | 335 | 333 | 336 | 335 | 333 |
| Pulverized coal ratio | Kg/t | 160 | 160 | 160 | 160 | 160 | 160 |

TABLE 2-continued

| | | | | | | | |
|---|---|---|---|---|---|---|---|
| Reducing material ratio | Kg/t | 499 | 495 | 493 | 496 | 495 | 493 |
| Blast temperature | ° C. | 1050 | 1050 | 1100 | 1050 | 1050 | 1100 |
| Coke strength | % | 85.5 | 85.5 | 85.5 | 85.5 | 85.5 | 85.5 |
| Volatile matter in pulverized coal | % | 15 | 15 | 15 | 25 | 15 | 15 |
| Granularity of pulverized coal** | % | 60 | 60 | 50 | 50 | 60 | 50 |
| Oxygen concentration* | % | 50 | 60 | 60 | 60 | 70 | 70 |
| Index of air permeability | — | 1.07 | 1.03 | 1.01 | 1.02 | 0.97 | 0.96 |

| | | Test conditions | | | | |
|---|---|---|---|---|---|---|
| | | 19 | 20 | 21 | 22 | 23 |
| Tapping amount | $T/d/m^3$ | 10000 | 10000 | 10000 | 10000 | 10000 |
| Coke ratio | Kg/t | 336 | 290 | 335 | 333 | 336 |
| Pulverized coal ratio | Kg/t | 160 | 210 | 160 | 160 | 160 |
| Reducing material ratio | Kg/t | 496 | 500 | 495 | 493 | 496 |
| Blast temperature | ° C. | 1050 | 1100 | 1050 | 1100 | 1050 |
| Coke strength | % | 85.5 | 87 | 84.5 | 84.5 | 84.5 |
| Volatile matter in pulverized coal | % | 25 | 25 | 15 | 15 | 25 |
| Granularity of pulverized coal** | % | 50 | 60 | 60 | 50 | 50 |
| Oxygen concentration* | % | 70 | 60 | 60 | 60 | 60 |
| Index of air permeability | — | 0.98 | 0.97 | 1.07 | 10.5 | 10.6 |

**74 mass %

*Oxygen concentration of carrier gas

TABLE 3

| | | Test conditions | | | | | | | | |
|---|---|---|---|---|---|---|---|---|---|---|
| | | 24 | 25 | 26 | 27 | 28 | 29 | 30 | 31 | 32 |
| Tapping amount | $T/d/m^3$ | 10000 | 10000 | 10000 | 10000 | 10000 | 10000 | 10000 | 10000 | 10000 |
| Coke ratio | Kg/t | 335 | 333 | 336 | 335 | 333 | 336 | 335 | 333 | 336 |
| Pulverized coal ratio | Kg/t | 160 | 160 | 160 | 160 | 160 | 160 | 160 | 160 | 160 |
| Reducing material ratio | Kg/t | 495 | 493 | 496 | 495 | 493 | 496 | 495 | 493 | 496 |
| Blast temperature | ° C. | 1050 | 1100 | 1050 | 1050 | 1100 | 1050 | 1050 | 1100 | 1100 |
| Coke strength | % | 84.5 | 84.5 | 84.5 | 82.5 | 82.5 | 82.5 | 82.5 | 82.5 | 82.5 |
| Volatile matter in pulverized coal | % | 15 | 15 | 25 | 15 | 15 | 25 | 15 | 15 | 25 |
| Granularity of pulverized coal** | % | 60 | 50 | 50 | 60 | 50 | 50 | 60 | 50 | 50 |
| Oxygen concentration of lance* | % | 70 | 70 | 70 | 70 | 70 | 70 | 80 | 80 | 80 |
| Index of air permeability | — | 1.02 | 1.00 | 1.01 | 1.08 | 1.06 | 1.07 | 1.03 | 1.01 | 1.02 |

**74 mass %

*Oxygen concentration of carrier gas

As mentioned above, according to an example of the blast furnace operation method of the invention, the coke strength ($DI^{150}_{15}$) of the lump coke charged from the furnace top is low (≤87%) and the granularity and volatile matter of the pulverized coal blown through the lance (−74 μM≤60 mass %, volatile matter ≥25 mass %) are low and the blast temperature (≤1100° C.) is low, so that when the method is applied even in the operation condition of decreasing the combustion efficiency, it is possible to improve the combustion efficiency of the pulverized coal and hence it is possible to increase the productivity and reduce $CO_2$ emission. Also, it is confirmed that if the operating conditions of the blast furnace are constant, the degree of freedom of the operation is increased by performing the above blast furnace operation.

In the invention, the following conditions are preferable. At first, it is preferable to use a pulverized coal having an average volatile matter of not less than 5 mass %. When the average volatile matter of the pulverized coal is less than 5 mass %, the coal is hard and the pulverization thereof becomes difficult to increase the cost.

The strength ($DI^{150}_{15}$) of the lump coke charged from the furnace top is preferable to be not less than 78%. When the strength ($DI^{150}_{15}$) of the lump coke is less than 78%, the coal is not shrunk sufficiently and hence non-carbonized coke is formed, resulting in the damage of the coke oven.

The weight ratio of the pulverized coal having a particle size of not more than 74 μm is preferable to be not less than 30%. When the weight ratio of the pulverized coal having a particle size of not more than 74 μm is less than 30%, the temperature rise of the pulverized coal is slow and the ignition becomes difficult to deteriorate the combustibility violently.

The blast temperature is preferable to be not lower than 900° C. Since bricks in a hot blowing furnace are designed so as to entangle them at 900-1200° C., when the blast temperature is lower than 900° C., the damage of bricks in the hot air furnace is caused.

The blowing amount of the pulverized coal per 1 ton of pig iron is not more than 300 kg/t–p. When the blowing amount of the pulverized coal exceeds 300 kg/t–p, the combustibility is significantly deteriorated to bring about the decrease of coke replacement rate, while the oxygen concentration or blast temperature is largely increased or the humidity of air blown is largely decreased for maintaining the temperature at the tip of the tuyere (theoretical combustion temperature), the adjustment of which becomes difficult in view of not only the operation but also the equipment capacity. A more preferable upper limit of the pulverized coal blowing amount is not more than 250 kg/t–p.

DESCRIPTION OF REFERENCE SYMBOLS

1 blast furnace, 2 blowpipe, 3 tuyere, 4 lance, 5 raceway

The invention claimed is:

1. A method of operating a blast furnace by blowing a pulverized coal at an amount of not less than 150 kg/t–p from tuyeres through a lance into a blast furnace, wherein when the operation is performed under two or more of the following three conditions a, b and c:

a. employing lump coke having a strength defined in JIS K2151 ($DI^{150}_{15}$) of not more than 87%, the lump coke being charged from a furnace top;

b. the pulverized coal blown through the tuyere containing not more than 60%, by mass, as a weight ratio of coal having a particle size of not more than 74 μm, the pulverized coal having an average volatile matter of not more than 25%, by mass; and c. a blast temperature blown through the tuyere is not higher than 1100° C.;

oxygen is simultaneously blown into the furnace with the blowing of the pulverized coals through the lance and a gas having an oxygen concentration of 60%-97%, by volume, is used as a carrier gas for the blowing of the pulverized coal.

2. The method of operating a blast furnace according to claim 1, wherein when the strength ($DI^{150}_{15}$) of the lump coke is not more than 85%, a gas having an oxygen concentration of 70%-97%, by volume, is used as a carrier gas.

3. The method of operating a blast furnace according to claim 1, wherein when the strength ($DI^{150}_{15}$) of the lump coke is not more than 83%, a gas having an oxygen concentration of 80%-97%, by volume, is used as a carrier gas.

4. The method of operating a blast furnace according to claim 1, wherein the strength ($DI^{150}_{15}$) of the lump coke is not less than 78%.

5. The method of operating a blast furnace according to claim 1, wherein a weight ratio of a pulverized coal having a particle size of not more than 74 μm is not less than 30%, by mass.

6. The method of operating a blast furnace according to claim 1, wherein the blast temperature is not less than 900° C.

7. The method of operating a blast furnace according to claim 1, wherein the amount of the pulverized coal blown is not more than 300 kg/t–p.

8. The method of operating a blast furnace according to claim 2, wherein a weight ratio of a pulverized coal having a particle size of not more than 74 μm is not less than 30%, by mass.

9. The method of operating a blast furnace according to claim 3, wherein a weight ratio of a pulverized coal having a particle size of not more than 74 μm is not less than 30%, by mass.

10. The method of operating a blast furnace according to claim 4, wherein a weight ratio of a pulverized coal having a particle size of not more than 74 μm is not less than 30%, by mass.

11. The method of operating a blast furnace according to claim 2, wherein the blast temperature is not less than 900° C.

12. The method of operating a blast furnace according to claim 3, wherein the blast temperature is not less than 900° C.

13. The method of operating a blast furnace according to claim 4, wherein the blast temperature is not less than 900° C.

14. The method of operating a blast furnace according to claim 5, wherein the blast temperature is not less than 900° C.

15. The method of operating a blast furnace according to claim 2, wherein the amount of the pulverized coal blown is not more than 300 kg/t–p.

16. The method of operating a blast furnace according to claim 3, wherein the amount of the pulverized coal blown is not more than 300 kg/t–p.

17. The method of operating a blast furnace according to claim 4, wherein the amount of the pulverized coal blown is not more than 300 kg/t–p.

18. The method of operating a blast furnace according to claim 5, wherein the amount of the pulverized coal blown is not more than 300 kg/t–p.

19. The method of operating a blast furnace according to claim 6, wherein the amount of the pulverized coal blown is not more than 300 kg/t–p.

20. The method of operating a blast furnace according to claim 14, wherein the amount of the pulverized coal blown is not more than 300 kg/t–p.

* * * * *